US011594353B2

(12) United States Patent
Takagi et al.

(10) Patent No.: US 11,594,353 B2
(45) Date of Patent: Feb. 28, 2023

(54) MAGNETIC POWDER CONTAINING SM—FE—N-BASED CRYSTAL PARTICLES, SINTERED MAGNET PRODUCED FROM SAME, METHOD FOR PRODUCING SAID MAGNETIC POWDER, AND METHOD FOR PRODUCING SAID SINTERED MAGNET

(71) Applicants: NATIONAL INSTITUTE OF ADVANCED INDUSTRIAL SCIENCE AND TECHNOLOGY, Tokyo (JP); Murata Manufacturing Co., Ltd., Kyoto-fu (JP)

(72) Inventors: Kenta Takagi, Nagoya (JP); Wataru Yamaguchi, Nagoya (JP); Takaaki Yokoyama, Nagaokakyo (JP); Kenji Sakaguchi, Nagaokakyo (JP); Kazuhiro Yoshii, Nagaokakyo (JP); Yuji Yokoyama, Nagaokakyo (JP)

(73) Assignees: NATIONAL INSTITUTE OF ADVANCED INDUSTRIAL SCIENCE AND TECHNOLOGY, Tokyo (JP); Murata Manufacturing Co., Ltd., Kyoto-fu (JP)

( * ) Notice: Subject to any disclaimer, the term of this patent is extended or adjusted under 35 U.S.C. 154(b) by 520 days.

(21) Appl. No.: 16/505,287

(22) Filed: Jul. 8, 2019

(65) Prior Publication Data

US 2019/0333661 A1 Oct. 31, 2019

Related U.S. Application Data

(63) Continuation of application No. PCT/JP2018/007849, filed on Mar. 1, 2018.

(30) Foreign Application Priority Data

Mar. 10, 2017 (JP) ..... JP2017-046463

(51) Int. Cl.
*H01F 1/059* (2006.01)
*B22F 3/14* (2006.01)
(Continued)

(52) U.S. Cl.
CPC ..... *H01F 1/059* (2013.01); *B22F 1/17* (2022.01); *B22F 3/14* (2013.01); *B22F 9/04* (2013.01);
(Continued)

(58) Field of Classification Search
CPC ..... B22F 2301/35; B22F 2301/355; B22F 2302/20; B22F 2303/20; B22F 2303/30;
(Continued)

(56) References Cited

U.S. PATENT DOCUMENTS 6,413,327 B1 * 7/2002 Okajima ..... H01F 1/0596 148/301

FOREIGN PATENT DOCUMENTS

CN 1027111 C 12/1994
JP H03-16102 A 1/1991
(Continued)

OTHER PUBLICATIONS

Kohei Kataoka, Masashi Matsuura, Nobuki Tezuka, Satoshi Sugimoto, "Influence of Swaging on the Magnetic Properties of Zn-Bonded Sm—Fe—N Magnets," Materials Transactions, vol. 56, No. 10 (2015), published Sep. 25, 2015, pp. 1698-1702. (Year: 2015).*
(Continued)

*Primary Examiner* — Vanessa T. Luk
(74) *Attorney, Agent, or Firm* — Studebaker & Brackett PC

(57) ABSTRACT

A sintered magnet contains Sm—Fe—N-based crystal grains and has high coercivity; and a magnetic powder is capable of forming a sintered magnet without lowering the coercivity even if heat is generated in association with the
(Continued)

sintering. A sintered magnet comprises a crystal phase composed of a plurality of Sm—Fe—N-based crystal grains and a nonmagnetic metal phase present between the Sm—Fe—N crystal grains adjacent to each other, wherein a ratio of Fe peak intensity $I_{Fe}$ to SmFeN peak intensity $I_{SmFeN}$ measured by an X-ray diffraction method is 0.2 or less. A magnetic powder comprises Sm—Fe—N-based crystal particles and a nonmagnetic metal layer covering surfaces of the Sm—Fe—N crystal particles.

11 Claims, 2 Drawing Sheets

(51) Int. Cl.

| | |
|---|---|
| ***H01F 1/053*** | (2006.01) |
| ***B22F 1/17*** | (2022.01) |
| ***B22F 9/04*** | (2006.01) |
| ***H01F 1/06*** | (2006.01) |

(52) U.S. Cl.
CPC ..... *H01F 1/0536* (2013.01); *H01F 1/065* (2013.01); *B22F 2009/046* (2013.01); *B22F 2009/049* (2013.01); *B22F 2201/03* (2013.01); *B22F 2301/40* (2013.01); *B22F 2302/20* (2013.01)

(58) Field of Classification Search
CPC . C22C 38/001; C22C 38/005; C22C 2202/02; H01F 1/053; H01F 1/0536; H01F 1/059; H01F 1/0593; H01F 1/0596; H01F 1/06; H01F 1/061; H01F 1/065; H01F 1/08; H01F 1/086; H01F 3/08; H01F 41/02; H01F 41/0206; H01F 41/0246
See application file for complete search history.

(56) References Cited

FOREIGN PATENT DOCUMENTS

| | | | | | |
|---|---|---|---|---|---|
| JP | 04360501 | A | * | 12/1992 | ..... H01F 1/059 |
| JP | H04-360501 | A | | 12/1992 | |
| JP | 05190311 | A | * | 7/1993 | ..... H01F 1/059 |
| JP | H05-190311 | A | | 7/1993 | |
| JP | 2000-286115 | A | | 10/2000 | |
| JP | 2004-146713 | A | | 5/2004 | |
| JP | 2005-171264 | A | | 6/2005 | |
| JP | 4419245 | B2 | | 2/2010 | |
| JP | 2015-142119 | A | | 8/2015 | |
| JP | 2016-082175 | A | | 5/2016 | |
| WO | 2010/071111 | A1 | | 6/2010 | |
| WO | 2015/199096 | A1 | | 12/2015 | |

OTHER PUBLICATIONS

"Glossary of Metallurgical and Metalworking Terms," Metals Handbook, ASM Handbooks Online, ASM International, 2002, pp. 1,21,125,182,257. (Year: 2002).*

M. Zinkevich, N. Mattern, A. Handstein, O. Gutfleisch, "Thermodynamics of Fe—Sm, Fe—H, and H—Sm systems and its application to the hydrogen-disproportionation-desorption-recombination (HDDR) process for the system Fe17Sm2—H2," Journal of Alloys and Compounds, 339 (2002), pp. 118-139. (Year: 2002).*

Tetsuji Saito et al.; "Magnetic properties of Sm—Fe—N bulk magnets produced from Cu-plated Sm—Fe—N powder" AIP Advances; Dec. 27, 2016; vol. 7; 056204.

Tetsuji Saito; "Magnetic properties of Sm—Fe—N anisotropic magnets produced by magnetic-field-assisted spark plasma sintering"; Materials Science and Engineering B; 2010; pp. 75-79; vol. 167.

D. Prabhu et al.; "Enhanced coercivity of spark plasma sintered Zn-bonded Sm—Fe—N magnets"; Scripta Materialia; 2012; pp. 153-156; vol. 67.

An Office Action; "Notice of Reasons for Refusal," mailed by the Japanese Patent Office dated Aug. 4, 2020, which corresponds to Japanese Patent Application No. 2019-504523 and is related to U.S. Appl. No. 16/505,287 with English language translation.

An Office Action mailed by China National Intellectual Property Administration dated Mar. 8, 2021, which corresponds to Chinese Patent Application No. 201880006182.X and is related to U.S. Appl. No. 16/505,287; with English language translation.

International Search Report issued in PCT/JP2018/007849; dated May 15, 2018.

International Preliminary Report On Patentability and Written Opinion issued in PCT/JP2018/007849; dated Sep. 10, 2019.

Kenta Takagi et al.; "Production of Sm2Fe17N3 sintered magnet with No. decrease in coercive force due to a low oxygen process"; Collected Abstracts of 2016 Autumn Meeting of The Japan Institute of Metals and Materials; Sep. 7, 2016; S3.2; total 4 pages.

Wataru Yamaguchi et al.; "Non-magnetic metal coating on Sm—Fe—N magnet powder by arc plasma vapor deposition method"; Collected Abstracts of 2016 Autumn Meeting of The Japan Institute of Metals and Materials; Sep. 7, 2016; total 4 pages.

* cited by examiner

MAGNETIC POWDER CONTAINING SM—FE—N-BASED CRYSTAL PARTICLES, SINTERED MAGNET PRODUCED FROM SAME, METHOD FOR PRODUCING SAID MAGNETIC POWDER, AND METHOD FOR PRODUCING SAID SINTERED MAGNET

CROSS-REFERENCE TO RELATED APPLICATIONS

This application claims benefit of priority to International Patent Application No. PCT/JP2018/007849, filed Mar. 1, 2018, and to Japanese Patent Application No. 2017-046463, filed Mar. 10, 2017, the entire contents of each are incorporated herein by reference.

BACKGROUND

Technical Field

The present disclosure relates to a magnetic powder containing Sm—Fe—N-based crystal particles, a sintered magnet produced from the magnetic powder, a method for producing the magnetic powder, and a method for producing the sintered magnet.

Background Art

An Sm—Fe—N-based magnet is representative of a rare earth-transition metal-nitrogen-based magnet, and has a high anisotropic magnetic field and saturation magnetization. The Sm—Fe—N-based magnet has a Curie temperature relatively higher than that of other rare earth-transition metal-nitrogen-based magnets, whereby the Sm—Fe—N-based magnet has excellent heat resistance. For this reason, the Sm—Fe—N-based magnet has been used as one of excellent materials for a magnetic powder.

Heretofore, in a step of forming a magnet from a magnetic powder, for the purposes of enhancing the corrosion resistance of the magnet and improving the alkali resistance, the magnetic powder has been covered, and the magnet has been then formed.

For example, a coating film is formed on the surface of a magnet alloy powder described in JP WO 2010/071111 A1, whereby the magnet alloy powder has excellent corrosion resistance and adhesion without causing rust to occur even in a corrosive environment. Specifically, an inorganic-organic composite coating film which contains composite metal phosphate containing iron phosphate and rare earth metal phosphate, and an organic compound containing polyphenol is uniformly formed on the surface of a magnetic powder made of an iron-based magnet alloy containing a rare earth element, whereby the magnetic powder has improved corrosion resistance and adhesion.

SUMMARY

However, in the iron-based magnetic powder having the surface having the coating film formed thereon, the coating film is rich in iron oxide because oxygen contained in phosphoric acid of the coating film causes an oxidation reaction with iron contained in the magnetic powder. When a sintered magnet is formed from the magnetic powder which contains iron oxide in the coating film, heat during sintering causes the reduction reaction of the iron oxide. Therefore, iron precipitates on the surface of the magnetic powder, which disadvantageously causes significantly decreased coercivity of the sintered magnet to be formed.

The present disclosure thus provides a sintered magnet which contains Sm—Fe—N-based crystal grains and has high coercivity; and a magnetic powder which can form a sintered magnet without decreasing the coercivity even if heat is generated in association with sintering.

A sintered magnet according to an aspect of the present disclosure contains a crystal phase composed of a plurality of Sm—Fe—N-based crystal grains; and a nonmagnetic metal phase present between the Sm—Fe—N-based crystal grains adjacent to each other, wherein a ratio of Fe peak intensity $I_{Fe}$ to SmFeN peak intensity $I_{SmFeN}$ measured by an X-ray diffraction method is 0.2 or less.

Also, a magnetic powder according to an aspect of the present disclosure contains Sm—Fe—N-based crystal particles; and a nonmagnetic metal layer covering surfaces of the Sm—Fe—N-based crystal particles.

Thus, the present disclosure makes it possible to provide a sintered magnet which contains Sm—Fe—N-based crystal grains and has high coercivity; and a magnetic powder which can form a sintered magnet without decreasing the coercivity even if heat is generated in association with sintering.

DETAILED DESCRIPTION

Figure 1:
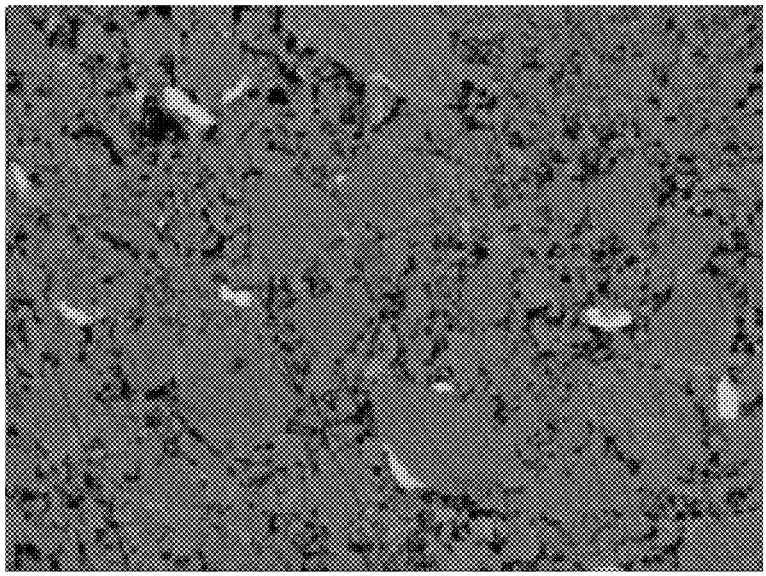
FIG. 1 is a SEM image of the cross section of a sintered magnet in Example 1 of the present disclosure.

A sintered magnet of the present disclosure contains a crystal phase composed of Sm—Fe—N-based crystal grains and a nonmagnetic metal phase. The two phases of the sintered magnet will be described in more detail below.

(Crystal Phase Composed of Sm—Fe—N-Based Crystal Grains)

The sintered magnet of the present disclosure contains a crystal phase composed of Sm—Fe—N-based crystal grains. The Sm—Fe—N-based crystal grains have a high anisotropic magnetic field and saturation magnetization, whereby the sintered magnet containing the crystal phase composed of Sm—Fe—N-based crystal grains has high anisotropy and saturation magnetization. The Curie temperature of a magnet having an Sm—Fe—N-based crystal structure is higher than that of other rare earth-transition metal-nitrogen-based magnets, whereby the sintered magnet containing the crystal phase composed of Sm—Fe—N-based crystal grains has excellent heat resistance. In the present disclosure, the Sm—Fe—N-based crystal grains refer to particles having an Sm—Fe—N-based crystal structure. Examples of the Sm—Fe—N-based crystal structure include, but not limited to, an $SmFe_9N_{1.5}$ structure or an $Sm_2Fe_{17}N_3$ structure, and any crystal structure composed of Sm, Fe, and N can be used. In the present disclosure, the crystal phase composed of Sm—Fe—N-based crystal grains refers to a phase of a region occupied by the Sm—Fe—N-based crystal grains in the sintered magnet of the present disclosure.

(Nonmagnetic Metal Phase)

The sintered magnet of the present disclosure contains a nonmagnetic metal phase present between the Sm—Fe—N-based crystal grains adjacent to each other. The nonmagnetic metal phase is a phase containing a nonmagnetic metal more than the crystal phase composed of Sm—Fe—N-based crystal grains. The nonmagnetic metal may be contained at a ratio of, for example, 10 mass % or more, preferably 15 mass % or more, and particularly 20 mass % or more in the nonmagnetic metal phase. The ratio may not be uniform over the entire nonmagnetic metal phase. The nonmagnetic metal phase is substantially free of a nonmagnetic metal oxide. Herein, the nonmagnetic metal phase being in a state of "being present between the Sm—Fe—N-based crystal grains adjacent to each other" means that nonmagnetic metal phases may be present on a part of the surfaces of the Sm—Fe—N-based crystal grains between the Sm—Fe—N-based crystal grains adjacent to each other among the Sm—Fe—N-based crystal grains contained in the sintered magnet, and the nonmagnetic metal phase may not be present on all of the Sm—Fe—N-based crystal grains between the Sm—Fe—N-based crystal grains adjacent to each other among the Sm—Fe—N-based crystal grains contained in the sintered magnet. In this state, the nonmagnetic metal phase may be present between a part of the Sm—Fe—N-based crystal grains adjacent to each other among the Sm—Fe—N-based crystal grains contained in the sintered magnet. Herein, the nonmagnetic metal refers to a metal other than a ferromagnetic metal (for example, iron, nickel, cobalt and the like). As the nonmagnetic metal, at least one metal selected from the group consisting of Zn, Al, Sn, Cu, Ti, Sm, Mo, Ru, Ta, W, Ce, La, V, Mn, and Zr can be used without being limited thereto. It is possible to optionally use one or more kinds of metals other than a ferromagnetic metal (for example, iron, nickel, cobalt and the like). The nonmagnetic metal phase may contain any other element in addition to a nonmagnetic metal element. The nonmagnetic metal phase may contain, for example, an element such as Fe, N, or C as the other element.

The sintered magnet of the present disclosure which contains at least the two phases described above will be described in more detail below.

(Sintered Magnet)

In the sintered magnet of the present disclosure, the nonmagnetic metal phase is present between the Sm—Fe—N-based crystal grains adjacent to each other, whereby magnetic interference between the Sm—Fe—N-based crystal grains is less likely to occur, which provides a suppressed decrease in coercivity of the sintered magnet. Therefore, the sintered magnet of the present disclosure has more excellent coercivity than that of a sintered magnet in which a nonmagnetic metal phase is not present between Sm—Fe—N-based crystal grains adjacent to each other.

In order to improve alkali resistance and corrosion resistance, it is known to cover the surface of the magnetic powder with an oxide of Zr and the like as described, for example, in JP 4419245 B2. However, Sm is more apt to be oxidized than Zr and the like forming an oxide, so that an oxidation-reduction reaction in which an oxide of Sm expressed by the following formula is formed may occur, for example, when the magnetic powder is sintered.

$$3ZrO_2+2Sm_2Fe_{17}N_3 \rightarrow 2Sm_2O_3+34Fe+3Zr+3N_2 \quad \text{[Chemical Formula 1]}$$

It has been found from the study of the present inventors that the reaction may cause Fe to be precipitated to cause decreased coercivity. In the present disclosure, the nonmagnetic metal phase substantially free of a nonmagnetic metal oxide is present between the Sm—Fe—N-based crystal grains adjacent to each other, whereby the efficient prevention of the oxidation of Sm described above and the precipitation of Fe which may be caused by the oxidation is realized. Thus, the precipitation of Fe is effectively suppressed, whereby a ratio of Fe peak intensity $I_{Fe}$ to SmFeN peak intensity $I_{SmFeN}$ of the sintered magnet of the present disclosure measured by an X-ray diffraction method is 0.2 or less. Here, the SmFeN peak intensity $I_{SmFeN}$ refers to the intensity of an SmFeN peak having the largest intensity among measured SmFeN peaks. The Fe peak intensity $I_{Fe}$ refers to the intensity of an α-Fe peak. In the sintered magnet having such an intensity ratio, the precipitation of iron on the surface of the magnetic powder which may occur during sintering is effectively suppressed, whereby the sintered magnet has excellent coercivity. The X-ray diffraction intensity of the sintered magnet of the present disclosure can be measured, for example, by pulverizing the sintered magnet of the present disclosure to about 10 to 100 μm with a stamp mill and performing powder XRD diffraction measurement with Smart Lab manufactured by Rigaku Corporation. The measuring method is not limited thereto, and any methods can be selected. The sintered magnet of the present disclosure has such a configuration, whereby the sintered magnet can have higher coercivity than that of a sintered magnet which does not has the configuration. In the present disclosure, the sintered magnet means a magnet obtained by sintering a magnetic powder at a high temperature.

In the sintered magnet of the present disclosure, the nonmagnetic metal phase may cover the surfaces of the Sm—Fe—N-based crystal grains. "The nonmagnetic metal phase covers the surfaces of the Sm—Fe—N-based crystal grains" refers to a state where most of the surfaces of the Sm—Fe—N-based crystal grains are covered with the nonmagnetic metal phase. For example, it means that the nonmagnetic metal phase is present in contact with the crystal grain boundary at a ratio of 80% or more, preferably 90% or more, and more preferably 95% or more in a line length on the crystal grain boundary of the cross section of the Sm—Fe—N-based crystal grains confirmed by cross-sectional observation by SEM. In the sintered magnet of the present disclosure, "the nonmagnetic metal phase covers the surfaces of the Sm—Fe—N-based crystal grains", whereby the magnetic interference between the Sm—Fe—N-based crystal grains is more effectively suppressed. Therefore, the decrease in coercivity of the sintered magnet is more effectively suppressed. In the sintered magnet according to the present disclosure, "the nonmagnetic metal phase covers the surfaces of the Sm—Fe—N-based crystal grains" can be confirmed by observation with cross-sectional SEM and TEM, and the like.

The content ratio of a metal which corresponds to the nonmagnetic metal contained in the nonmagnetic metal phase except for Sm, in the crystal phase composed of Sm—Fe—N-based crystal grains may be 1 mass % or less. When two or more nonmagnetic metals other than Sm are contained in the nonmagnetic metal phase of the present disclosure, "the content ratio of a metal which corresponds to the nonmagnetic metal contained in the nonmagnetic metal phase except for Sm, in the crystal phase" refers to the ratio of the total mass of metals occupied by the crystal phase composed of Sm—Fe—N-based crystal grains. The metals correspond to two or more kinds of nonmagnetic metals other than Sm contained in the nonmagnetic metal phase with respect to the mass of the entire crystal phase composed of Sm—Fe—N-based crystal grains. In the sintered magnet in the present disclosure, the mass % of the nonmagnetic metal with respect to the total mass of the crystal phase composed of Sm—Fe—N-based crystal grains can be confirmed by analyzing the composition of the sintered magnet using ICP-AES, and the like.

It is preferable that an oxygen content ratio in the sintered magnet of the present disclosure is 0.7 mass % or less with respect to the total mass of the sintered magnet. This makes it possible to reduce the precipitation of α-Fe due to the oxidation-reduction reaction during sintering, to suppress the decrease in coercivity. The oxygen content ratio in the sintered magnet of the present disclosure can be confirmed by inert gas melting-nondispersive infrared absorption method (NDIR) and the like.

A carbon content ratio in the sintered magnet of the present disclosure is at least 1 mass % or less, preferably 0.5 mass % or less, and more preferably 0.1 mass % or less, with respect to the total mass of the sintered magnet. This makes it possible to reduce the precipitation of Sm—Fe—N, C during sintering, to suppress the decrease in coercivity. The carbon content ratio in the sintered magnet of the present disclosure can be confirmed by a combustion-infrared absorption method and the like.

In the sintered magnet of the present disclosure, the thickness of the nonmagnetic metal phase may be 1 nm or more and less than 400 nm (i.e., from 1 nm to 400 nm). The thickness of the nonmagnetic metal phase is less than 400 nm, whereby the decrease in the magnetization of the sintered magnet can be effectively suppressed. The thickness of the nonmagnetic metal phase is 1 nm or more, whereby the suppressing effect of the decrease in the magnetization of the sintered magnet can be confirmed. Furthermore, the thickness of the nonmagnetic metal phase is 250 nm or less, whereby the decrease in the magnetization of the sintered magnet can be more effectively suppressed. The thickness of the nonmagnetic metal phase is 50 nm or more, whereby exchange coupling between magnet particles can be effectively decoupled, which makes it possible to provide improved coercivity of the sintered magnet. Therefore, the thickness of the nonmagnetic metal phase may be, for example, 50 nm or more and 250 nm or less (i.e., from 50 nm to 250 nm). Thus, by increasing the thickness of the nonmagnetic metal phase in an appropriate range, a magnetic coupling blocking effect is enhanced, whereby high coercivity, for example, coercivity of 11.5 kOe or more, and particularly 11.9 kOe or more can be realized. Alternatively, the thickness of the nonmagnetic metal phase is 10 nm or less, which can exhibit an effect of substantially enhancing the saturation magnetization as compared with the case where the nonmagnetic metal phase is not present (more specifically, a saturation magnetization ratio as compared with the case where the nonmagnetic metal phase is not present). Therefore, the thickness of the nonmagnetic metal phase may be, for example, 1 nm or more and 10 nm or less (i.e., from 1 nm to 10 nm). Thus, the thickness of the nonmagnetic metal phase is as thin as possible within a range in which the suppression effect of the decrease in the magnetization of the sintered magnet is obtained, whereby the saturation magnetization can be substantially enhanced as compared with the case where the nonmagnetic metal phase is not present.

The thickness of the nonmagnetic metal phase herein is obtained by dividing a volume $V_1$ occupied by the nonmagnetic metal phase per unit mass of the sintered magnet by a total surface area $A_2$ of the Sm—Fe—N-based crystal grains contained in the unit mass of the sintered magnet.

The volume $V_1$ occupied by the nonmagnetic metal phase per unit mass of the sintered magnet is calculated by the following procedure.

1) A mass $W_1$ of the nonmagnetic metal element per unit mass of the sintered magnet is measured by analyzing the composition of the sintered magnet by, for example, ICP-AES and the like. Here, when two or more kinds of nonmagnetic metal elements are contained in the sintered magnet, the mass $W_1$ refers to the ratio of the total mass of the two or more kinds of nonmagnetic metal elements.

2) The composition of the sintered magnet is analyzed by, for example, SEM-EDX and the like to measure the mass % of the nonmagnetic metal element in the nonmagnetic metal phase. The $W_1$ is divided by the mass % to calculate a mass $W_2$ of the nonmagnetic metal phase.

3) The sintered magnet is analyzed by using, for example, a pycnometer and the like to measure a true density $D_1$ indicating the volume of the magnetic metal element per unit mass of the sintered magnet. Here, when two or more kinds of nonmagnetic metal elements are contained in the sintered magnet, the true density $D_1$ refers to the ratio of the total mass of the two or more kinds of nonmagnetic metal elements.

4) By dividing the mass $W_2$ measured as described above by the true density $D_1$, the volume $V_1$ occupied by the nonmagnetic metal phase per unit mass of the sintered magnet is obtained.

The total surface area $A_2$ of the Sm—Fe—N-based crystal grains contained per unit mass of the sintered magnet is calculated by the following procedure.

1) Using a pycnometer, a true density $D_2$ per unit volume of the sintered magnet which does not contain surface pores or internal voids is measured. By multiplying the true density $D_2$ by the volume per particle, a mass $W_2=D_2\times(\pi d^3)/6$ per particle is calculated. In the formula, d is an average grain size of the sintered magnet of the present disclosure calculated by a method to be described later. Furthermore, the number of particles contained per unit mass of the sintered magnet is calculated by $N_2=1/W_2$.

2) From the obtained number $N_2$, the total surface area $A_2=N_2\times\pi d^2$ of the Sm—Fe—N-based crystal grains contained per unit mass of the sintered magnet is calculated. In the formula, d is an average grain size of the sintered magnet of the present disclosure calculated by a method to be described later.

Any average grain size can be used for the Sm—Fe—N-based crystal grains, and Sm—Fe—N-based crystal grains having an average grain size of 0.04 μm or more and 5 μm or less (i.e., from 0.04 μm to 5 μm) are preferably used. The average grain size of the Sm—Fe—N-based crystal grains is 0.04 μm or more, whereby the superparamagnetization of the Sm—Fe—N-based crystal grains can be effectively suppressed. The average grain size of the Sm—Fe—N-based crystal grains is 5 μm or less, whereby the coercivity can be effectively improved.

The calculation method of the "average grain size" of the crystal grains in the sintered magnet herein is as follows. First, the cross section of the sintered magnet is photographed by FE-SEM so as to contain at least 50 or more crystal particles. The total area A of the cross sections of the crystal particles in the photographed image and the number N of the crystal particles are determined. Next, an average cross-sectional area al of the crystal particles is determined by A/N. The square root of the average cross-sectional area al is calculated as the average grain size d of the crystal particles. Herein, the term "average particle size" used excluding crystal grains in the sintered magnet is a particle size (D50) of a point at which an accumulated value is 50% in a cumulative curve with 100% of the total volume according to a particle size distribution determined on volume basis. The average particle size can be measured by using a laser diffraction-scattering type particle size/particle size distribution measuring apparatus or an electron scanning microscope.

The sintered magnet described above is obtained by sintering the magnetic powder of the present disclosure. The magnetic powder of the present disclosure and the method for producing the magnetic powder will be described below.

(Magnetic Powder)

The magnetic powder of the present disclosure contains Sm—Fe—N-based crystal particles and a nonmagnetic metal layer covering the surfaces of the Sm—Fe—N-based crystal particles. Herein, the nonmagnetic metal layer refers to a layer substantially containing only a nonmagnetic metal. The nonmagnetic metal layer covering the surfaces of the Sm—Fe—N-based crystal particles refers to a state where most of the surfaces of the Sm—Fe—N-based crystal grains are covered with the nonmagnetic metal. For example, it means that the nonmagnetic metal is present in contact with the crystal grain boundary at a ratio of 80% or more, preferably 90% or more, and more preferably 95% or more in a line length on the crystal grain boundary of the cross section of the Sm—Fe—N-based crystal grains. In the magnetic powder of the present disclosure, "the nonmagnetic metal layer covers the surfaces of the Sm—Fe—N-based crystal particles", whereby the occurrence of rust is suppressed even in a corrosive environment, which provides improved corrosion resistance of the magnetic powder. By reducing the exposure of the surfaces of the Sm—Fe—N-based crystal particles to the atmosphere, the occurrence of iron oxide on the surfaces of the Sm—Fe—N-based crystal particles when the magnetic powder is sintered can be reduced, whereby the precipitation of iron on the surfaces of the Sm—Fe—N-based crystal grains contained in the formed sintered magnet can be reduced to enhance the coercivity of the formed sintered magnet.

(Method for Producing Magnetic Powder)

A method for producing a magnetic powder of the present disclosure includes the steps of pulverizing a coarse powder containing an Sm—Fe—N single crystal to obtain Sm—Fe—N-based crystal particles; cutting a nonmagnetic metal to obtain a nonmagnetic metal powder; and covering surfaces of the obtained Sm—Fe—N-based crystal particles with the obtained nonmagnetic metal powder. All the steps are performed under a low oxygen concentration atmosphere. As the coarse powder, for example, a coarse powder having a composition of $Sm_2Fe_{17}N_3$ and having an average particle size of 10 μm or more and 200 μm or less (i.e., from 10 μm to 200 μm) and an oxygen content ratio of 0.1 mass % or more and 1.0 mass % or less (i.e., from 0.1 mass % to 1.0 mass %) can be used. Any pulverization methods can be used for pulverizing the coarse powder. For example, MC44 which is a flow current pulverizing type jet mill and is manufactured by Micromacinazione, and the like can be used without being limited thereto. The coarse powder is preferably pulverized until the Sm—Fe—N-based crystal particles obtained by pulverizing have an average particle size of 0.1 μm or more and 5.0 μm or less (i.e., from 0.1 μm to 5.0 μm). The coarse powder is pulverized until the Sm—Fe—N-based crystal particles of this size are obtained, whereby the obtained crystal particles have coercivity of 5 kOe or more and 20 kOe or less (i.e., from 5 kOe to 20 kOe). Herein, the low oxygen concentration atmosphere means a state where the oxygen concentration (volume basis, the same herein) is 10 ppm or less. For example, an oxygen concentration of 1 ppm or 0.5 ppm and the like can be used as the low oxygen concentration atmosphere. Pulverizing and cutting in the low oxygen concentration atmosphere can be achieved in a glove box replaced with nitrogen, argon, nitrogen, and helium and the like, and preferably in a glove box connected with a gas circulation type oxygen moisture purifier. The purity of the nonmagnetic metal to be cut may be 95% or more, and preferably 99% or more. Any cutting methods can be used for cutting the nonmagnetic metal. For example, a carbide grinder and a carbide drill and the like can be used without being limited thereto. Any methods can be used to cover the Sm—Fe—N-based crystal particles with the nonmagnetic metal powder. Any methods such as a ball mill, an arc plasma method, and a sputtering method can be used. The amount of the nonmagnetic metal used for covering may be 0.1 mass % or more and 10 mass % or less (i.e., from 0.1 mass % to 10 mass %), and preferably 0.5 mass % or more and 5 mass % or less (i.e., from 0.5 mass % to 5 mass %) with respect to the total mass of the Sm—Fe—N-based crystal particles to be covered. The amount of the nonmagnetic metal used for covering may be, for example, 5 mass %, 6 mass %, 8 mass % and 10 mass %.

The method for producing the sintered magnet of the present disclosure from the magnetic powder of the present disclosure produced as described above will be described below.

(Method for Producing Sintered Magnet)

The sintered magnet of the present disclosure can be produced by pressure-sintering the magnetic powder of the present disclosure produced as described above under a low oxygen concentration atmosphere. For pressure-sintering the magnetic powder, any pressure-sintering methods including electric pressure-sintering can be used. The pressure-sintering may be performed as follows. For example, a magnetic powder is filled in a die, and the die is placed in a pulse electric sintering machine equipped with a pressure control mechanism including a servo control type pressing device without exposing the die to the atmosphere. Then, a constant pressure is applied to the die while a vacuum in the pulse electric sintering machine is maintained, and electric sintering is performed while the pressure is held. The die to be used may have any shape. For example, a cylindrical die may be used without being limited thereto. In the pulse electric sintering machine, a vacuum of 5 Pa (absolute pressure, the same herein) or less is preferably maintained. The pressure to be applied is higher than normal pressure, and may be any pressure which can form a sintered magnet. The pressure may be, for example, within a range of 100 MPa or more and 2000 MPa or less (i.e., from 100 MPa to 2000 MPa). The electric sintering is preferably performed at a temperature of 400° C. or more and 600° C. or less (i.e., from 400° C. to 600° C.) for a time of 30 seconds or more and 10 minutes or less (i.e., from 30 seconds to 10 minutes).

EXAMPLES

Examples 1 to 8 and Comparative Examples 1 and 2

Preparation of Sm—Fe—N-Based Crystal Particles

A coarse powder (a) having a composition of $Sm_2Fe_{17}N_3$ and an average particle size of about 25 μm was prepared as a raw material of a magnetic powder. The coarse powder (a) contained an Sm—Fe—N-based single crystal, and had an oxygen content ratio of 0.20 mass % and coercivity of 0.07 kOe. A flow current pulverizing type jet mill was used, and the prepared coarse powder (a) was pulverized until its average particle size became 2 μm, to prepare 100 g of Sm—Fe—N-based crystal particles (A). In order to prevent the oxidation of the powder, the jet mill was placed in a glove box where the powder was pulverized. A gas circulation type oxygen moisture purifier was connected to the glove box. The coercivity of the Sm—Fe—N-based crystal particles (A) obtained after pulverizing was 10.8 kOe.

Preparation of Nonmagnetic Metal Powder and Covering of Sm—Fe—N-Based Crystal Particles with Nonmagnetic Metal Powder (Preparation of Magnetic Powder)

Then, as a nonmagnetic metal for covering, Zn having a purity of 99.99 mass % was cut by using a carbide grinder in the glove box in which the coarse powder was pulverized, to prepare a nonmagnetic metal powder. The nonmagnetic metal powder and the Sm—Fe—N-based crystal particles (A) prepared above were mixed with a ball mill installed in the glove box, to cover the Sm—Fe—N-based crystal particles (A) with the nonmagnetic metal, thereby obtaining a magnetic powder. In order to change the covering thickness, two kinds of magnetic powders were prepared by changing the ratio of the nonmagnetic metal Zn with respect to the total mass of the Sm—Fe—N-based crystal particles (A) to be covered. In Example 1, the ratio of the nonmagnetic metal Zn with respect to the total mass of the Sm—Fe—N-based crystal particles (A) was 5 mass %. In the magnetic powder used in Example 2, the ratio was 8 mass %. Furthermore, the Sm—Fe—N-based crystal particles (A) prepared above was used, and magnetic powders independently containing Al, Sn, Cu, Ti, and Sm in place of Zn were prepared as a nonmagnetic metal. Each of the magnetic powders which independently contains Al, Sn, Cu, Ti, and Sm as the nonmagnetic metal was prepared as only one kind such that the ratio of the nonmagnetic metal with respect to the total mass of the Sm—Fe—N-based crystal particles (A) to be covered was 6 mass %. These were used as magnetic powders used in Examples 3 to 7.

Preparation of Sintered Magnet (Pressure-Sintering of Magnetic Powder)

Then, the magnetic powders for Examples 1 to 7 obtained by the above steps were subjected to the following operations. 0.5 g of the magnetic powder was weighed, and filled in a carbide cylindrical die having an inner diameter of 6 mm. This was installed in a pulse electric sintering machine equipped with a pressurizing mechanism including a servo control type pressing device without being exposed to the atmosphere. Next, a pressure of 1200 MPa was applied while a vacuum of 2 Pa or less and an oxygen concentration of 0.4 ppm or less were maintained in the pulse electric sintering machine. Electric sintering was performed at a sintering temperature of 500° C. for 2 minutes while the pressure was maintained. Thereby, sintered magnets of Examples 1 to 7 were obtained.

The Sm—Fe—N-based crystal particles (A) prepared above were used, and the pulverizing step and the sintering step were performed in the same manner as in Example 1 except that the mixing using the ball mill as the covering method was changed to an arc plasma method, to produce a sintered magnet of Example 8. The amount of Zn added by the arc plasma method was 6 mass % with respect to the total mass of the Sm—Fe—N-based crystal particles (A) to be covered.

The Sm—Fe—N-based crystal particles (A) prepared above was used, and the pulverizing step and the sintering step were performed in the same manner as in Example 1 except that a step of covering the Sm—Fe—N-based crystal particles (A) with the nonmagnetic metal was not performed, to produce a sintered magnet as Comparative Example 1. Furthermore, the Sm—Fe—N-based crystal particles (A) prepared above was used, and the pulverizing step and the sintering step were performed in the same manner as in Example 1 except that the ratio of the nonmagnetic metal with respect to the total mass of the Sm—Fe—N-based crystal particles (A) to be covered was changed to 10 mass %, to produce a sintered magnet as Comparative Example 2.

The characteristics of the obtained sintered magnet were shown in Table 1. In Table 1, the "nonmagnetic metal" means the nonmagnetic metal used for covering. The symbol "-" for a "thickness of nonmagnetic metal phase" means that the "nonmagnetic metal phase is not present" is confirmed from SEM observation. A "saturation magnetization ratio" means the ratio of the saturation magnetization of each Example or Comparative Example to the saturation magnetization of Comparative Example with the "nonmagnetic metal" for covering as "none" (the same applies to Tables 3 and 4 described later). The "saturation magnetization ratio" in Table 1 is based on the saturation magnetization of Comparative Example 1.

TABLE 1

| | Nonmagnetic metal | Thickness of nonmagnetic metal phase [nm] | Average grain size of crystal grains [μm] | $I_{Fe}/I_{SmFeN}$ [—] | Oxygen content ratio [mass %] | Carbon content ratio [mass %] | Coercivity [kOe] | Saturation magnetization [kG] | Saturation magnetization ratio [—] |
|---|---|---|---|---|---|---|---|---|---|
| Example 1 | Zn | 50 | 2.0 | 0.01 | 0.33 | 0.05 | 14.0 | 13.8 | 1.01 |
| Example 2 | Zn | 250 | 2.0 | 0.02 | 0.27 | 0.05 | 12.5 | 13.6 | 0.99 |
| Example 3 | Al | 100 | 1.9 | 0.20 | 0.50 | 0.04 | 13.3 | 13.7 | 1.00 |
| Example 4 | Sn | 100 | 2.0 | 0.05 | 0.63 | 0.06 | 12.2 | 13.6 | 0.99 |
| Example 5 | Cu | 100 | 2.0 | 0.02 | 0.54 | 0.05 | 11.9 | 13.6 | 0.99 |
| Example 6 | Ti | 100 | 2.1 | 0.10 | 0.51 | 0.05 | 12.2 | 13.5 | 0.99 |
| Example 7 | Sm | 100 | 2.0 | 0.01 | 0.70 | 0.07 | 12.8 | 13.7 | 1.00 |
| Example 8 | Zn | 100 | 2.0 | 0.01 | 0.56 | 0.06 | 11.5 | 13.8 | 1.01 |
| Comparative Example 1 | None | — | 2.0 | 0.10 | 0.52 | 0.05 | 11.2 | 13.7 | 1.00 |
| Comparative Example 2 | Zn | 400 | 2.0 | 0.50 | 0.57 | 0.04 | 5.2 | 12.8 | 0.93 |

In Table 1, the thickness of the nonmagnetic metal phase is a value calculated according to the method described above herein. Schematically, the thickness of the covering layer can be more specifically understood as the average value of the thicknesses of the nonmagnetic metal phase covering Sm—Fe—N-based crystal grains (the same applies to Tables 3 and 4 described later). In Examples 1 to 8, the thickness of the nonmagnetic metal phase in the produced sintered magnet was confirmed as follows from SEM observation. The thickness was 50 nm in example 1 in which the ratio of the nonmagnetic metal with respect to the total mass of the Sm—Fe—N-based crystal particles to be covered was 5 mass %. In Examples 3 to 8 in which the ratio was 6 mass %, the thickness was 100 nm. In Example 2 in which the ratio was 8 mass %, the thickness was 250 nm. In Comparative Example 2 in which the ratio was 10 mass %, the thickness was 400 nm. In Comparative Example 1 in which the ratio was 0 mass %, the "nonmagnetic metal phase was not present".

In Table 1, the average grain size of the crystal grains means the average grain size of the Sm—Fe—N-based crystal grains (the same applies to Tables 3 and 4 described later). The average grain sizes of the crystal grains in Examples 1 to 8 and Comparative Examples 1 and 2 were within a range of 1.9 to 2.1 μm, and was substantially uniform.

Figure 3:
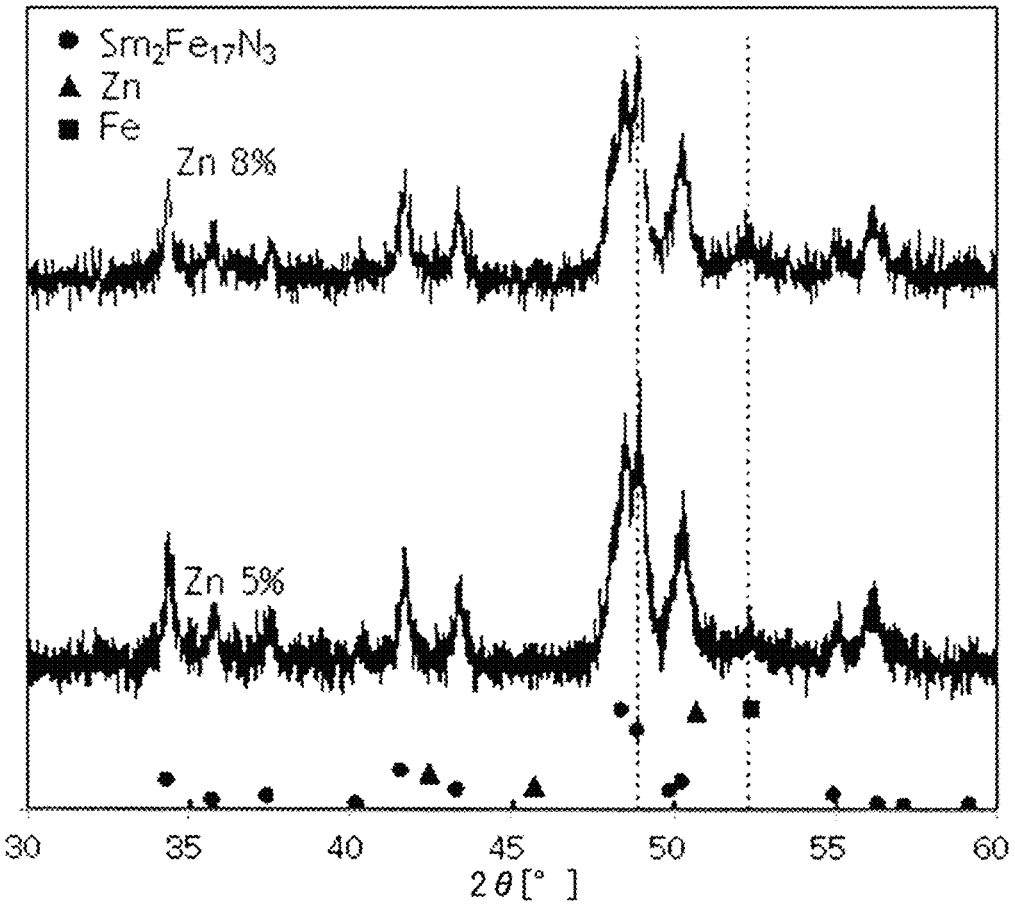
FIG. 3 shows the X-ray diffraction pattern of the sintered magnet in each of Examples 1 and 2 of the present disclosure obtained by measurement with an X-ray diffractometer.

In Table 1, $I_{Fe}/I_{SmFeN}$ means the ratio of Fe peak intensity $I_{Fe}$ to SmFeN peak intensity $I_{SmFeN}$ measured by an X-ray diffraction method (the same applies to Tables 3 and 4 described later). Hereinafter, it is also merely referred to as an "XRD peak intensity ratio". FIG. 3 shows X-ray diffraction patterns measured for the sintered magnets of Examples 1 and 2 (In FIG. 3, the lower X-ray diffraction pattern to which "Zn 5%" is applied is data of Example 1, and the upper X-ray diffraction pattern to which "Zn 8%" is applied is data of Example 2). The XRD peak intensity ratio of Examples 1 and 2 means the ratio of the peak intensity $I_{Fe}$ of a (110) plane (■) of α-Fe shown in a state where a dotted line is overlapped at a position of 2θ=52° in FIG. 3 to the peak intensity $I_{SmFeN}$ of a (220) plane shown in a state where a dotted line is overlapped at a position of 2θ=48° in FIG. 3 among the measured SmFeN peaks (●). XRD peak intensity ratios were similarly determined from X-ray diffraction intensities for the other Examples and Comparative Examples. All the above peaks appear sharply in FIG. 3, but the peak intensity $I_{SmFeN}$ may be the intensity of a broad peak including the peak of the (220) plane of SmFeN, and the peak intensity $I_{Fe}$ may be the intensity of a broad peak including the peak of the (110) plane of Fe. In the sintered magnets of Examples 1 to 8 produced by using the magnetic powder covered with the nonmagnetic metal, the XRD peak intensity ratio was within a range of 0.2 or less, and the sintered magnet had excellent coercivity and high saturation magnetization. The reason why the XRD peak intensity ratio can be set to 0.2 or less in each Example is considered to be because the oxygen concentration around the magnetic powder is sufficiently low during sintering. The oxygen concentration is preferably 10 ppm or less, and more preferably 1 ppm or less in order to set the XRD peak intensity ratio to 0.2 or less.

The coercivity in Table 1 is measured by a vibrating sample magnetometer (VSM) and the like (the same applies to Tables 3 and 4 described later). In each of Examples 1 to 8, the coercivity was 11.5 kOe or more, whereby the coercivity was not decreased by sintering, which could produce a sintered magnet having excellent coercivity. In particular, in Examples 1 to 7 in which the Sm—Fe—N-based crystal particles were covered with the nonmagnetic metal powder using the ball mill, the coercivity was 11.9 kOe or more, whereby a sintered magnet having more excellent coercivity could be produced.

The saturation magnetization in Table 1 is measured by a vibrating sample magnetometer (VSM) and the like as in the coercivity (the same applies to Tables 3 and 4 described later). In each of Examples 1 to 8, the saturation magnetization is 13.5 kG or more. The saturation magnetization ratio (based on Comparative Example 1 which uses the same Sm—Fe—N-based crystal particles (A) but is not covered with the nonmagnetic metal powder) is 0.99 or more, and more specifically within a range of 0.99 to 1.01. The high saturation magnetization of the Sm—Fe—N-based crystal particles is not substantially impaired, whereby it can be said that a sintered magnet having good magnetic properties can be produced.

The sintered magnet of Comparative Example 1 had saturation magnetization of 13.5 kG or more as in Examples 1 to 8, but the coercivity was 11.2 kOe, which was less than 11.5 kOe. The Sm—Fe—N-based crystal particles of the magnetic powder as the raw material of Comparative Example 1 are not covered with the nonmagnetic metal, whereby the surfaces of the Sm—Fe—N-based crystal grains of the obtained sintered magnet are not covered with the nonmagnetic metal layer. For this reason, it is considered that, in the sintered magnet of Comparative Example 1, the magnetic interference of the Sm—Fe—N-based crystal grains is apt to occur as compared with the sintered magnets of Examples 1 to 8, so that the coercivity of the sintered magnet is decreased.

The coercivity of the sintered magnet of Comparative Example 2 is significantly lower than that of Examples 1 to 8, and the saturation magnetization is also less than 13.5 kG of Examples 1 to 8. This is considered to be because the increase in the ratio of the mass of the nonmagnetic metal to the total mass of the sintered magnet as compared with Examples 1 to 8 causes impaired magnetic properties of the sintered magnet of Comparative Example 2.

In summary, from Table 1, it was confirmed that the sintered magnets of Examples 1 to 8 in which the nonmagnetic metal phase is present between the Sm—Fe—N-based crystal grains and the XRD peak intensity ratio is 0.2 or less have higher coercivity than that of the sintered magnet of Comparative Example 1 in which the nonmagnetic metal phase is not present between the Sm—Fe—N-based crystal grains and the sintered magnet of Comparative Example 2 in which the XRD peak intensity ratio is more than 0.2. In the sintered magnets of Examples 1 to 8, the thickness of the nonmagnetic metal phase was 50 nm or more and 250 nm or less (i.e., from 50 nm to 250 nm), and high coercivity of 11.5 kOe or more, and particularly 11.9 kOe or more was achieved.

FIG. 1 is a SEM image of the cross section of a sintered magnet of Example 1. A gray phase in FIG. 1 is a crystal phase composed of Sm—Fe—N-based crystal grains. The number of crystal grains and the cross-sectional area were measured by using an image analysis software "WinROOF" manufactured by Mitani Corporation. In FIG. 1, it is found that the surfaces of the Sm—Fe—N-based crystal grains constituting the crystal phase are covered with a light gray phase. The light gray phase is a nonmagnetic metal (zinc in Example 1) phase. From the SEM image of FIG. 1, it was found that the sintered magnet of Example 1 contains a crystal phase composed of a plurality of Sm—Fe—N-based crystal grains and a nonmagnetic metal phase present between Sm—Fe—N-based crystal grains adjacent to each other.

Figure 2:
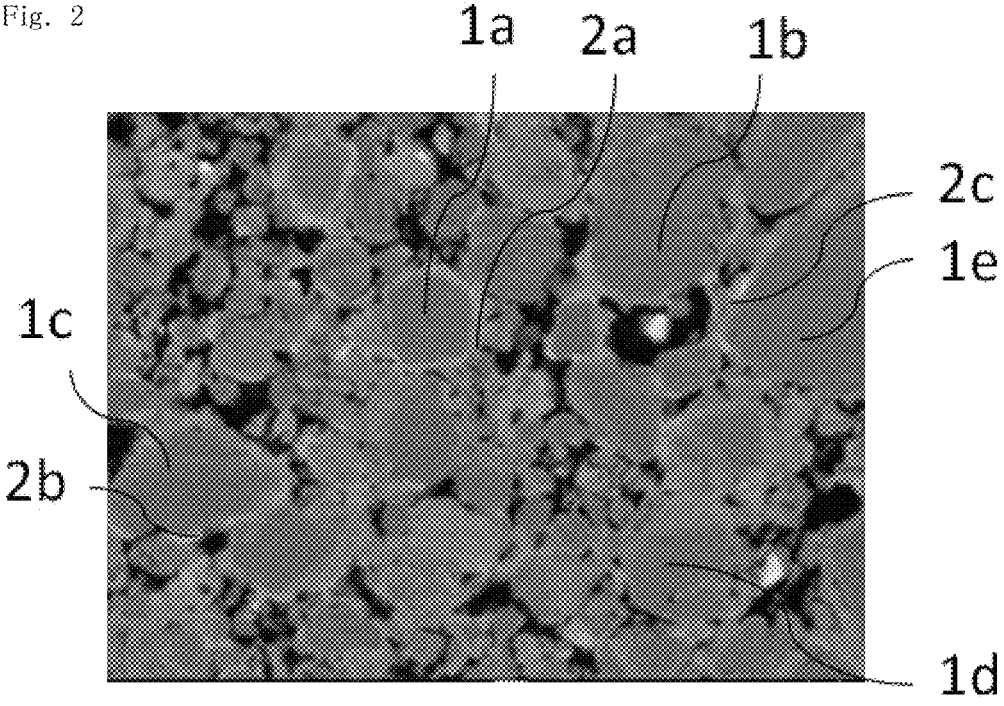
FIG. 2 is a SEM image of the cross section of a sintered magnet in Example 2 of the present disclosure.

FIG. 2 is a SEM image of the cross section of a sintered magnet of Example 2. A gray phase in FIG. 2 is a crystal phase composed of Sm—Fe—N-based crystal grains. The number of crystal grains and the cross-sectional area were measured by using an image analysis software "WinROOF" manufactured by Mitani Corporation. In FIG. 2, it is found that the surfaces of the Sm—Fe—N-based crystal grains constituting the crystal phase are covered with a light gray phase. This light gray phase is a nonmagnetic metal (zinc in Example 2) phase. Using a SEM apparatus JSM-7800 manufactured by JEOL, the compositions of points 1a to 1e on the gray phase and points 2a to 2c on the light gray phase were analyzed by EDX analysis. The results of the composition analysis are shown in Table 2.

TABLE 2

| | Sm [mass %] | Fe [mass %] | Zn [mass %] |
|---|---|---|---|
| 1a | 25.07 | 74.50 | 0.43 |
| 1b | 23.38 | 75.99 | 0.63 |
| 1c | 22.71 | 77.29 | 0.00 |
| 1d | 22.80 | 77.01 | 0.19 |
| 1e | 22.82 | 76.18 | 1.00 |
| 2a | 43.99 | 40.14 | 15.87 |
| 2b | 34.41 | 42.44 | 23.15 |
| 2c | 40.61 | 34.36 | 25.02 |

In the points 1a to 1e of Table 2, a metal which corresponded to the nonmagnetic metal contained in the nonmagnetic metal phase except for Sm (zinc in Example 2) was contained at a ratio of only 1 mass % or less. In contrast, in the points 2a to 2c, the above metal (in other words, the nonmagnetic metal contained in the nonmagnetic metal phase except for Sm) (zinc in Example 2) was contained at a ratio of 15.87 mass % or more and 25.02 mass % or less (i.e., from 15.87 mass % to 25.02 mass %). From the results of the composition analysis in Table 2 and the SEM image in FIG. 2, it was found that the sintered magnet obtained by the producing method of the present disclosure contains the crystal phase composed of a plurality of Sm—Fe—N-based crystal grains and the nonmagnetic metal phase being present between the Sm—Fe—N-based crystal grains adjacent to each other and containing the nonmagnetic metal more than the crystal phase composed of Sm—Fe—N-based crystal grains.

Examples 9 to 17 and Comparative Example 3

Preparation of Sm—Fe—N-Based Crystal Particles

A coarse powder (b) having a composition of $Sm_2Fe_{17}N_3$ and an average particle size of about 29 μm was prepared as a raw material of a magnetic powder. The coarse powder (b) contained an Sm—Fe—N-based single crystal, and had an oxygen content ratio of 0.30 mass % and coercivity of 0.35 kOe. A flow current pulverizing type jet mill was used, and the prepared coarse powder (b) was pulverized until its average particle size became 1.5 μm, to prepare 100 g of Sm—Fe—N-based crystal particles (B). In order to prevent the oxidation of the powder, the jet mill was placed in a glove box where the powder was pulverized. A gas circulation type oxygen moisture purifier was connected to the glove box. The coercivity of the Sm—Fe—N-based crystal particles (B) obtained after pulverizing was 10.3 kOe.

Preparation of Nonmagnetic Metal Powder and Covering of Sm—Fe—N-Based Crystal Particles with Nonmagnetic Metal Powder (Preparation of Magnetic Powder)

Then, as a nonmagnetic metal for covering, Zn having a purity of 99.99 mass % was cut, to prepare a nonmagnetic metal powder. The Sm—Fe—N-based crystal particles (B) prepared above were covered with the nonmagnetic metal powder by using a sputtering method, to prepare a magnetic powder used in Example 9. Magnetic powders used for Examples 10 to 17 were prepared in the same manner as in Example 9 except that Sm, Ti, Cu, Mo, Ru, Ta, W, and Ce were used as the nonmagnetic metal for covering in place of Zn.

Preparation of Sintered Magnet (Pressure-Sintering of Magnetic Powder)

Then, the magnetic powders for Examples 9 to 17 obtained by the above steps were subjected to the following operations. 0.5 g of the magnetic powder was weighed, and filled in a carbide cylindrical die having an inner diameter of 6 mm. This was installed in a pulse electric sintering machine equipped with a pressurizing mechanism including a servo control type pressing device without being exposed to the atmosphere. Next, a pressure of 1200 MPa was applied while a vacuum of 2 Pa or less and an oxygen concentration of 0.4 ppm or less were maintained in the pulse electric sintering machine. Electric sintering was performed at a sintering temperature of 500° C. for 1 minute while the pressure was maintained. Thereby, sintered magnets of Examples 9 to 17 were obtained.

A sintered magnet was prepared as Comparative Example 3 in the same manner as Example 9 except that a step of covering the Sm—Fe—N-based crystal particles (B) prepared above with a nonmagnetic metal was not performed.

The characteristics of the obtained sintered magnet were shown in Table 3. A "saturation magnetization ratio" in Table 3 is based on the saturation magnetization of Comparative Example 3.

TABLE 3

| | Nonmagnetic metal | Thickness of nonmagnetic metal phase [nm] | Average grain size of crystal grains [μm] | $I_{Fe}/I_{SmFeN}$ [—] | Oxygen content ratio [mass %] | Carbon content ratio [mass %] | Coercivity [kOe] | Saturation magnetization [kG] | Saturation magnetization ratio [—] |
|---|---|---|---|---|---|---|---|---|---|
| Example 9 | Zn | 4 | 1.5 | 0.10 | 0.41 | 0.43 | 14.2 | 11.8 | 1.16 |
| Example 10 | Sm | 4 | 1.5 | 0.09 | 0.58 | 0.87 | 10.6 | 10.1 | 0.99 |
| Example 11 | Ti | 2 | 1.5 | 0.15 | 0.66 | 0.65 | 10.9 | 11.1 | 1.09 |
| Example 12 | Cu | 6 | 1.5 | 0.06 | 0.65 | 0.75 | 11.9 | 10.1 | 0.99 |
| Example 13 | Mo | 4 | 1.6 | 0.08 | 0.53 | 0.43 | 11.3 | 10.8 | 1.06 |
| Example 14 | Ru | 3 | 1.6 | 0.07 | 0.48 | 0.34 | 12.6 | 11.2 | 1.10 |
| Example 15 | Ta | 2 | 1.6 | 0.10 | 0.44 | 0.31 | 10.8 | 10.6 | 1.04 |
| Example 16 | W | 2 | 1.6 | 0.09 | 0.54 | 0.28 | 11.5 | 10.4 | 1.02 |
| Example 17 | Ce | 4 | 1.6 | 0.12 | 0.63 | 0.48 | 11.9 | 10.9 | 1.07 |
| Comparative Example 3 | None | — | 1.5 | 0.11 | 0.60 | 0.53 | 10.1 | 10.2 | 1.00 |

From Table 3, it was confirmed that the sintered magnets of Examples 9 to 17 in which the nonmagnetic metal phase is present between the Sm—Fe—N-based crystal grains and the XRD peak intensity ratio is 0.2 or less have coercivity higher than that of the sintered magnet of Comparative Example 3 in which the nonmagnetic metal phase is not present between the Sm—Fe—N-based crystal grains. In each of Examples 9 to 17, the saturation magnetization was 10.1 kG or more. The saturation magnetization ratio (based on Comparative Example 3 which used the same Sm—Fe—N-based crystal particles (B) but was not covered with the nonmagnetic metal powder) was 0.99 or more, and more specifically within a range of 0.99 to 1.16. The high saturation magnetization of the Sm—Fe—N-based crystal particles was not substantially impaired. The cases of Examples 9 to 17 provided an overall saturation magnetization ratio higher than that in the cases of Examples 1 to 8. This is considered to be because, in Examples 1 to 8, the thickness of the nonmagnetic metal phase is 50 nm or more and 250 nm or less (i.e., from 50 nm to 250 nm), by contrast, in Examples 9 to 17, the thickness of the nonmagnetic metal phase is thinner, and specifically within a range of 1 nm or more and 10 nm or less (i.e., from 1 nm to 10 nm) (note that the Sm—Fe—N-based crystal particles used in the cases of Examples 1 to 8 and Comparative Examples 1 to 2 are different from those in the cases of Examples 9 to 17 and Comparative Example 3, so that the coercivities and the saturation magnetizations cannot be simply compared with each other).

Examples 18 to 23 and Comparative Example 4

Preparation of Sm—Fe—N-Based Crystal Particles

As a raw material of a magnetic powder, a coarse powder (c) having a composition of $Sm_2Fe_{17}N_3$ and an average particle size of about 23 μm was prepared. The coarse powder (c) contained an Sm—Fe—N-based single crystal, and had an oxygen content of 0.20 mass % and coercivity of 0.70 kOe. A flow current pulverizing type jet mill was used, and the prepared coarse powder (c) was pulverized until its average particle size became 1.7 μm, to prepare 100 g of Sm—Fe—N-based crystal particles (c). In order to prevent the oxidation of the powder, the jet mill was placed in a glove box where the powder was pulverized. A gas circulation type oxygen moisture purifier was connected to the glove box. The coercivity of the Sm—Fe—N-based crystal particles (C) obtained after pulverizing was 9.4 kOe.

Preparation of Nonmagnetic Metal Powder and Covering of Sm—Fe—N-Based Crystal Particles with Nonmagnetic Metal Powder (Preparation of Magnetic Powder)

Then, as a nonmagnetic metal for covering, Al having a purity of 99.99 mass % was cut, to prepare a nonmagnetic metal powder. The Sm—Fe—N-based crystal particles (C) prepared above were covered with the nonmagnetic metal powder by using a sputtering method, to prepare a magnetic powder used in Example 18. Magnetic powders used for Examples 19 to 23 were prepared in the same manner as in Example 18 except that Sn, La, V, Mn, and Zr were used as the nonmagnetic metal for covering in place of Al.

Preparation of Sintered Magnet (Pressure-Sintering of Magnetic Powder)

Then, the magnetic powders for Examples 18 to 23 obtained by the above steps were subjected to the following operations. 0.5 g of the magnetic powder was weighed, and filled in a carbide cylindrical die having an inner diameter of 6 mm. This was installed in a pulse electric sintering machine equipped with a pressurizing mechanism including a servo control type pressing device without being exposed to the atmosphere. Next, a pressure of 1200 MPa was applied while a vacuum of 2 Pa or less and an oxygen concentration of 0.4 ppm or less were maintained in the pulse electric sintering machine. Electric sintering was performed at a sintering temperature of 500° C. for 1 minute while the pressure was maintained. Thereby, sintered magnets of Examples 18 to 23 were obtained.

A sintered magnet was produced as Comparative Example 4 in the same manner as Example 18 except that a step of covering the Sm—Fe—N-based crystal particles (C) prepared above with a nonmagnetic metal was not performed.

The characteristics of the obtained sintered magnet were shown in Table 4. A "saturation magnetization ratio" in Table 4 is based on the saturation magnetization of Comparative Example 4.

TABLE 4

| | Nonmagnetic metal | Thickness of nonmagnetic metal phase [nm] | Average grain size of crystal grains [μm] | $I_{Fe}/I_{SmFeN}$ [—] | Oxygen content ratio [mass %] | Carbon content ratio [mass %] | Coercivity [kOe] | Saturation magnetization [kG] | Saturation magnetization ratio [—] |
|---|---|---|---|---|---|---|---|---|---|
| Example 18 | Al | 4 | 1.7 | 0.11 | 0.52 | 0.56 | 8.3 | 11.5 | 1.14 |
| Example 19 | Sn | 8 | 19 | 0.08 | 0.61 | 0.49 | 10.0 | 10.0 | 0.99 |
| Example 20 | La | 6 | 2.4 | 0.05 | 0.51 | 0.46 | 8.0 | 11.3 | 1.12 |
| Example 21 | V | 1 | 2.4 | 0.06 | 0.42 | 0.51 | 8.1 | 11.3 | 1.12 |
| Example 22 | Mn | 5 | 2.4 | 0.04 | 0.65 | 0.55 | 8.0 | 11.1 | 1.10 |
| Example 23 | Zr | 6 | 2.4 | 0.13 | 0.34 | 0.77 | 8.1 | 11.7 | 1.16 |
| Comparative Example 4 | None | — | 1.7 | 0.07 | 0.54 | 0.45 | 7.7 | 10.1 | 1.00 |

From Table 4, it was confirmed that the sintered magnets of Examples 18 to 23 in which the nonmagnetic metal phase is present between the Sm—Fe—N-based crystal grains and the XRD peak intensity ratio is 0.2 or less have coercivity higher than that of the sintered magnet of Comparative Example 4 in which the nonmagnetic metal phase is not present between the Sm—Fe—N-based crystal grains. In each of Examples 18 to 23, the saturation magnetization was 10.0 kG or more. The saturation magnetization ratio (based on Comparative Example 4 which used the same Sm—Fe—N-based crystal particles (C) but was not covered with the nonmagnetic metal powder) was 0.99 or more, and more specifically within a range of 0.99 to 1.16. The high saturation magnetization of the Sm—Fe—N-based crystal particles was not substantially impaired. The cases of Examples 18 to 23 provided an overall saturation magnetization ratio higher than that in the cases of Examples 1 to 8. This is considered to be because, in Examples 1 to 8, the thickness of the nonmagnetic metal phase is 50 nm or more and 250 nm or less (i.e., from 50 nm to 250 nm), by contrast, in Examples 18 to 23, the thickness of the nonmagnetic metal phase is thinner, and specifically within a range of 1 nm or more and 10 nm or less (i.e., from 1 nm to 10 nm) (note that the Sm—Fe—N-based crystal particles used are different in the cases of Examples 1 to 8 and Comparative Examples 1 and 2, the cases of Examples 9 to 17 and Comparative Example 3, and the cases of Examples 17 and 18 and Comparative Example 4, whereby the coercivities and the saturation magnetizations cannot be simply compared with each other).

The sintered magnet and the magnetic powder of the present disclosure can be used in a wide range of applications in the field of various motors. For example, the sintered magnet and the magnetic powder can be used for an in-car auxiliary motor and EV/HEV main machine motor and the like. More specifically, the sintered magnet and the magnetic powder can be used for an oil pump motor, an electric power steering motor, and an EV/HEV drive motor and the like.

What is claimed is:

1. A sintered magnet comprising:

a crystal phase composed of a plurality of Sm—Fe—N-based crystal grains; and a nonmagnetic metal phase present between the Sm—Fe—N-based crystal grains adjacent to each other, wherein a ratio of Fe peak intensity $I_{Fe}$ to SmFeN peak intensity $I_{SmFeN}$ measured by an X-ray diffraction method is 0.2 or less, wherein the nonmagnetic metal phase covers surfaces of the Sm—Fe—N-based crystal grains, wherein the nonmagnetic metal phase comprises at least one metal selected from the group consisting of Al, Cu, Ti, Sm, Mo, Ru, Ta, W, Ce, La, V, Mn, and Zr, wherein the sintered magnet has coercivity of 10.6 kOe or more, wherein the sintered magnet has saturation magnetization of 10.1 kG or more, and wherein the nonmagnetic metal phase is present in contact with the crystal grain boundary at a ratio of 80% or more in a line length on the crystal grain boundary of the Sm—Fe—N-based crystal grains.

2. The sintered magnet according to claim 1, wherein a content ratio of a metal which corresponds to a nonmagnetic metal contained in the nonmagnetic metal phase except for Sm, in the crystal phase is 1 mass % or less.

3. The sintered magnet according to claim 1, wherein the sintered magnet has an oxygen content ratio of 0.7 mass % or less.

4. The sintered magnet according to claim 1, wherein the nonmagnetic metal phase has a thickness from 1 nm to 400 nm.

5. The sintered magnet according to claim 4, wherein the nonmagnetic metal phase has a thickness from 50 nm to 250 nm.

6. The sintered magnet according to claim 5, wherein the sintered magnet has coercivity of 11.5 kOe or more.

7. The sintered magnet according to claim 6, wherein the sintered magnet has coercivity of 11.9 kOe or more.

8. The sintered magnet according to claim 4, wherein the nonmagnetic metal phase has a thickness from 1 nm to 10 nm.

9. The sintered magnet according to claim 1, wherein the sintered magnet has a carbon content ratio of 1 mass % or less.

10. The sintered magnet according to claim 1, wherein an average grain size of the Sm—Fe—N-based crystal grains is from 0.04 μm to 5 μm.

11. A method for producing the sintered magnet according to claim 1, the method comprising pressure-sintering magnetic powder under a low oxygen concentration atmosphere, the magnetic powder comprising:

Sm—Fe—N-based crystal particles; and a nonmagnetic metal layer covering surfaces of the Sm—Fe—N-based crystal particles.

* * * * *